United States Patent [19]

Pfarrwaller

[11] 4,192,356

[45] Mar. 11, 1980

[54] CATCHER MECHANISM IN A GRIPPER PROJECTILE WEAVING MACHINE AND METHOD OF OPERATING SAME

[75] Inventor: Erwin Pfarrwaller, Winterthur, Switzerland

[73] Assignee: Sulzer Brothers Limited, Winterthur, Switzerland

[21] Appl. No.: 910,087

[22] Filed: May 26, 1978

[30] Foreign Application Priority Data

Jun. 1, 1977 [CH] Switzerland ..... 006708/77

[51] Int. Cl.[2] ..... D03D 47/24

[52] U.S. Cl. ..... 139/439

[58] Field of Search ..... 139/437, 438, 439

[56] References Cited

U.S. PATENT DOCUMENTS

| | | | |
|---|---|---|---|
| 2,702,054 | 2/1955 | Pfarrwaller | 139/439 |
| 2,865,405 | 12/1958 | Pfarrwaller | 139/439 |

*Primary Examiner*—Henry Jaudon

*Attorney, Agent, or Firm*—Kenyon & Kenyon

[57] ABSTRACT

A method of operating a catcher mechanism in a gripper projectile weaving machine and a catcher mechanism for performing the method are disclosed. The projectile ejection portion of the catcher mechanism is operated by opening the projectile yarn clip, ejecting the projectile from the picking path, closing the yarn clip and moving the members of the ejection mechanism out of the picking path by pivoting the members sufficiently to permit immediate entry of a following projectile prior to returning the ejection mechanism to the initial position.

2 Claims, 4 Drawing Figures

CATCHER MECHANISM IN A GRIPPER PROJECTILE WEAVING MACHINE AND METHOD OF OPERATING SAME

BACKGROUND OF THE INVENTION

This invention relates generally to a catcher mechanism in a gripper projectile weaving machine including the method of operating such a mechanism and in particular relates to a projectile ejection mechanism.

Heretofore, it has been known, to use various types of catchers and openers in weaving machines which employ gripper shuttles or projectiles. In some cases, the catcher cooperates with an opener such that each gripper shuttle which is shot through a picking path is opened and then moved out of the picking path so that a following shuttle can be caught. However, the openers which have been used to effect the required opening and movement of the shuttles have interfered with a rapid operation of the weaving machine. For example, as described in German Pat. No. 922,400, one known ejection mechanism for opening and moving a gripper shuttle has parts, such as an opener pin for a shuttle yarn clip or clamp and, if required, another part to hold the shuttle in an axial direction (a clamp or another insertion pin), which are pivoted out of the shuttle after a lateral movement of the shuttle only to such an extent that the shuttle is free. In a following return movement phase, these parts are moved on immediately above the shuttle and are guided into the initial position. The picking path is, however, blocked until these parts return to the initial position. Thus, a following projectile cannot be received in the catcher until the ejection mechanism has returned to the initial position.

Accordingly, an object of this invention is to provide a catcher mechanism and method of operating the ejection mechanism of the catcher mechanism which overcomes the deficiencies of the prior art.

It is another object of this invention to provide a catcher mechanism for use in a gripper projectile weaving machine having an increased picking capacity thus increasing the overall speed of the machine.

It is a further object of this invention to provide a catcher mechanism which is adapted to rapidly accept projectiles therein.

SUMMARY OF THE INVENTION

Briefly, the invention is directed to a catcher mechanism for a gripper shuttle (projectile) having a pair of jaws (clip) for holding a yarn therebetween. The catcher mechanism has a housing disposed in a feed path of a gripper shuttle to receive the shuttle at a preset location and an ejection mechanism. The ejection mechanism includes an opener pin for opening the jaws of a shuttle at the preset location and an opener lever having the pin mounted thereon and being pivotally movable from a set position towards the preset location of the shuttle to effect opening of the shuttle jaws. The ejection mechanism also includes first means for pivoting the lever from the set position towards the preset location of the shuttle and second means for reciprocally moving the lever laterally of the feed path from the preset location to permit ejection of an opened gripper shuttle. These two means are disposed to pivot the opener lever away from the ejection position to permit ejection of a gripper shuttle and to a position with the lever and pin out of the feed path at a distance sufficient to permit entry of a following shuttle prior to movement of the lever laterally to the set or initial position. In this manner, the following gripper shuttle can be received at the preset location.

The invention also provides a method wherein an ejection mechanism performs four basic functions or phases which are as follows:

(a) opening of a shuttle yarn clip by an inward pivoting of an opener lever;

(b) ejection of the shuttle from the picking path;

(c) closing of the yarn clip by an outward pivoting of the opener lever; and (d) return of the ejection mechanism to the initial position.

The present invention, the parts of the ejection mechanism moved during the closing phase or step are pivoted out of the picking path to such an extent that a following projectile may enter the catching mechanism immediately and prior to the return movement step. Accordingly, the catcher mechanism apparatus for performing the method of the invention moves those parts of the ejection mechanism which are operated during the closing phase out of the picking path. The parts are pivoted out of the picking path to such an extent that a following projectile or shuttle may enter the catcher mechanism immediately after the closing step and prior to the return movement step.

Included in the parts to be pivoted outwards with the shuttle are the opener pin and, possibly, the positioning gripper or pin. These parts are pivoted, during the outward pivoting step, farther away from the shuttle through an angle such that they no longer project into the shuttle trajectory (picking path) at the outermost portion. The picking path is thus completely free at a time earlier than with prior art means thus permitting the next shuttle to enter the catcher mechanism more rapidly than previously. The weaving machine speed and hence the picking capacity are thus increased.

The moving parts of the ejection mechanism may, for example, be driven mechanically, e.g. by cams in accordance with U.S. Pat. No. 2,702,054. The catcher mechanism drive may be mechanical, hydraulic, pneumatic or electrical.

These and other objects and advantages of the invention will become more apparent from the following detailed description taken in conjunction with the accompanying drawings.

DESCRIPTION OF THE PREFERRED EMBODIMENT

Figure 1:
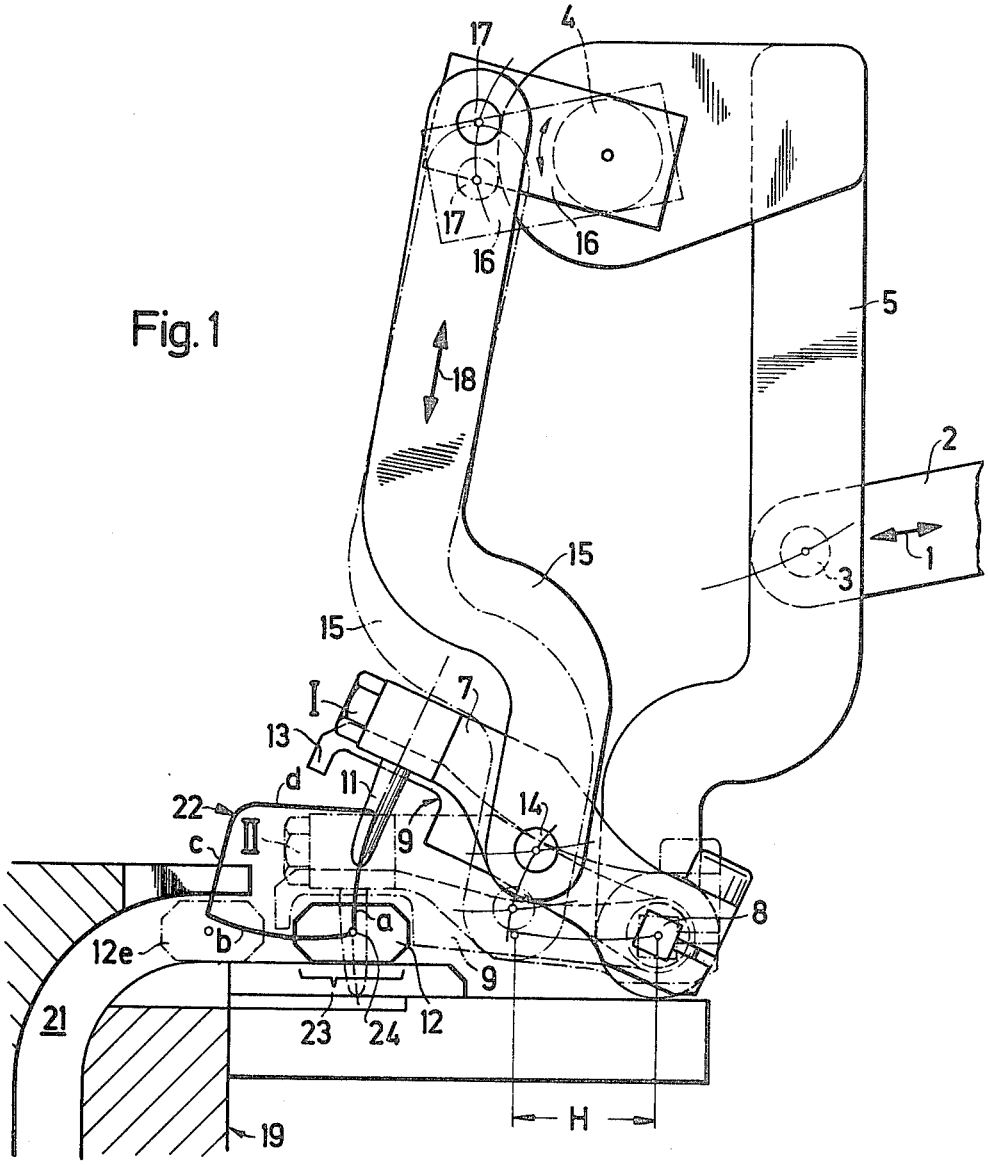
FIG. 1 is a front elevation view, partially in cross-section, of part of an ejection mechanism used in the catcher mechanism of a gripper projectile weaving machine constructed according to the present invention.

Referring to FIG. 1, the catcher mechanism has a housing 19 disposed in a feed or picking path of a gripper shuttle 12 in order to receive the shuttle 12 in known manner at a preset location. The housing 19 also has an ejection channel 21 to receive and transport an ejected shuttle 12 to a picking mechanism (not shown) in known manner.

Figure 2:
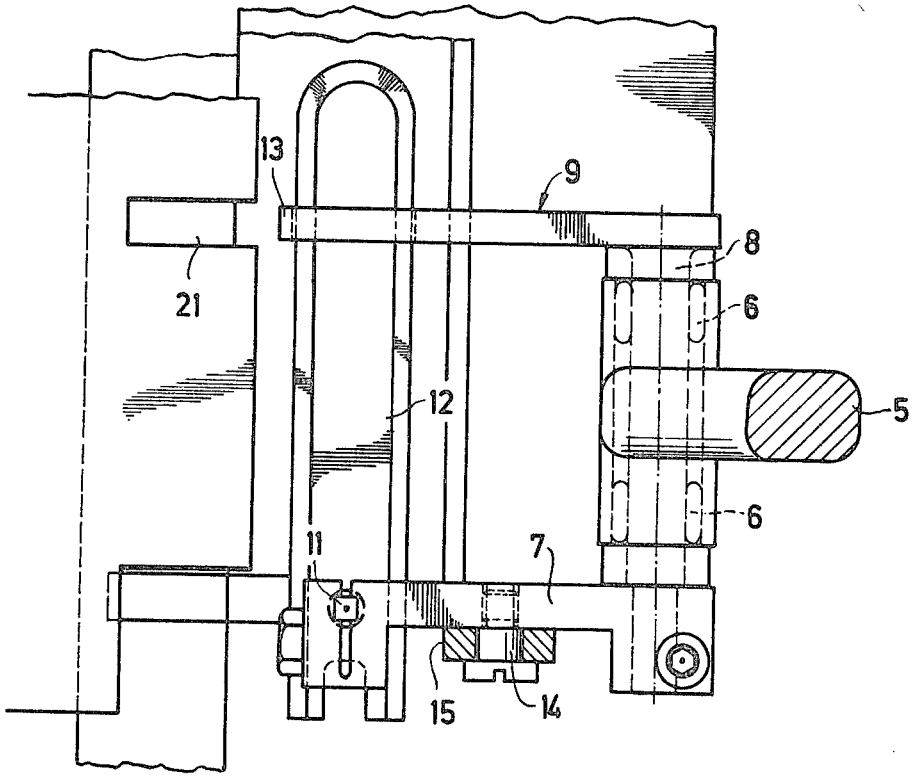
FIG. 2 is a plan view of the ejection mechanism of FIG. 1.

The catcher mechanism also has an ejection mechanism for ejecting the shuttle 12 via the channel 21. This ejection mechanism includes an opener lever 7 and a gripper lever 9 which are connected to opposite ends of a shaft 8 (FIG. 2) which is journalled in a bearing 6. The opener lever 7 carries an opener pin 11 for opening the jaws of the shuttle 12. As shown in FIG. 2, the pin 11 is fixed in a bifurcated end of the lever 7 and is held in place via a bolt. The levers 7, 9 are pivotally movable from a set position shown in solid line in FIG. 1 towards the preset location of the shuttle 12 to effect opening of the jaws (not shown) of the shuttle 12. To this end, the ejection mechanism has a first means for pivoting the opener lever 7 from the set position towards the shuttle preset location and a second means for reciprocally moving the lever laterally of the feed or picking path from the preset location to permit ejection of the opened shuttle via the channel 21.

The two means are disposed to pivot the opener lever 7 away from the preset location prior to movement of the lever laterally to the set position whereby a following shuttle can be received at the preset location. As shown in FIG. 1, the first means includes a pivotable drive lever 16 which is pivoted about a shaft 4 and a link 15 which is pivotally connected at opposite ends to the drive lever 16 and to the opener lever 7 via a bolt 14. The drive lever 16 is pivotable about the shaft 4 so that the movement of the link 15 is up and down as indicated by the arrow 18 in FIG. 1. The other means includes a drive rod 2 which is reciprocable in the direction indicated by the arrow 1. The rod 2 is connected to the levers 7, 9 via a lever 5 which is connected to the bearing 6 at one end so as to be pivotally connected to the opener lever 7 and intermediately to the drive rod 2 via a suitable pivot 3. The lever 5 is also pivotally mounted on the shaft 4.

The free end of the gripper lever 9 has a claw 13 shaped to mate with the cross-section of the shuttle 12. In this manner, the claw 13 embraces the upper portion of the shuttle 12 to hold the shuttle 12 in an azial position as shown in FIGS. 1 and 2.

When a shuttle 12 enters the catching mechanism 19 during operation, the shuttle is stopped by a braking means not shown and brought into the solid-line position shown in FIGS. 1 and 2. At that time, the levers 7, 9 are moved from the initial position I in FIG. 1 (solid-line) to the broken-line position II. This movement is accomplished by the downward movement of link 15 and drive shaft 16. In this position, the pin 11 engages the yarn clip of the shuttle 12 and opens the same (yarn release position). Also while at this position, claw 13 is in engagement with shuttle 12. Movement of levers 7,9 from initial position I to position II is represented as an initial phase or step a in the substantially square curve 22 of FIG. 1.

Figure 3:
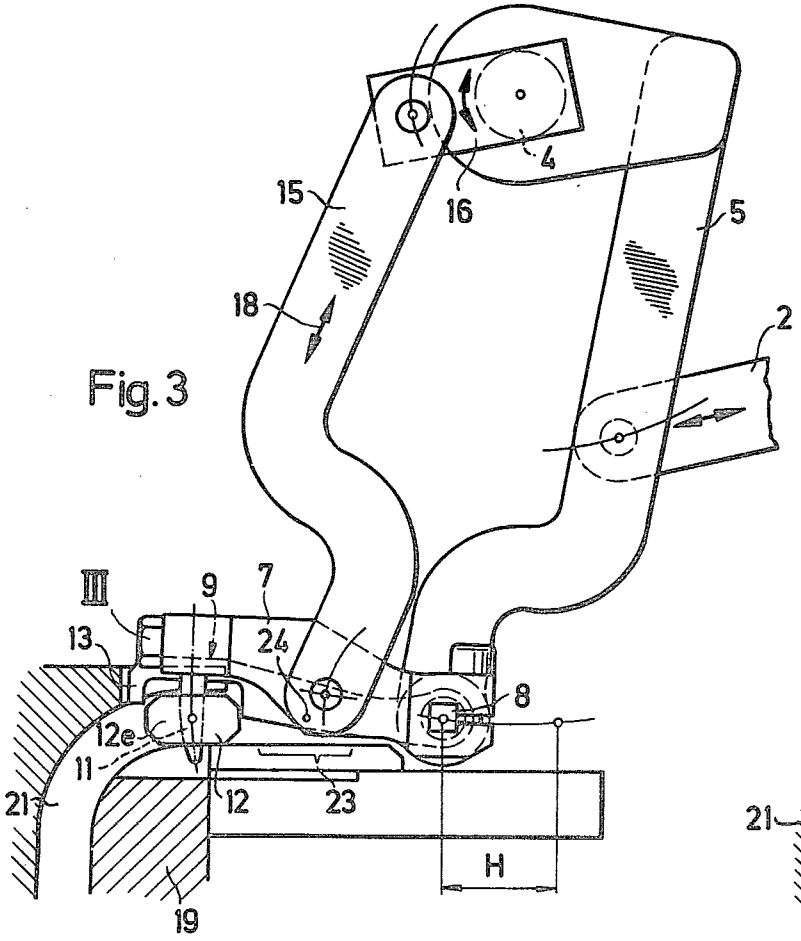
FIG. 3 is an enlarged fragmentary elevation view, partially in cross section, depicting the movement of the levers in the ejection mechanism.

During the next phase or step b of curve 22 (FIG. 1), the levers 7, 9 are moved a distance H out of position II and into position III as shown in FIG. 3, the movement being caused by means of the drive rod 2. The shuttle 12 is thus moved to the position 12*e*, out of the picking path 23 (picking line 24).

Figure 4:
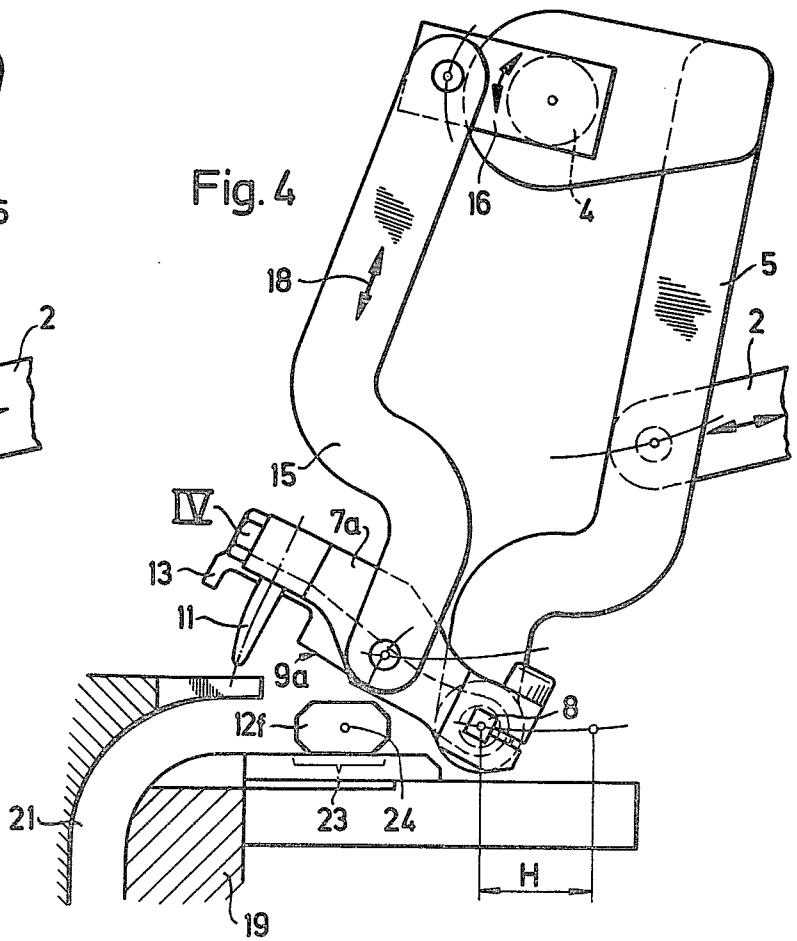
FIG. 4 is an enlarged fragmentary elevation view, partially in cross section, depicting further movement of the levers of the ejection mechanism.

In the next phase or step c of the curve 22, the levers 7, 9 are brought out of position III up into a raised position IV as shown in FIG. 4. Levers 7, 9 are so moved by the drive lever 16 pivoting in the clockwise direction about shaft 4. This movement causes pin 11 to leave the yarn clip of the shuttle 12 (closing of clip) while claw 13 simultaneously releases the shuttle. Phase c, i.e., movement from position III to IV, is designed such that the shuttle trajectory or picking path 23 is free and ready to receive a subsequent shuttle prior to the return phase or step. At this point, the arms 7*a* and 9*a* of the levers 7, 9 (see FIG. 4) have already been lifted to such an extent that a following shuttle 12*f* may readily enter the picking path 23.

The levers 7, 9 are then moved out of position IV into the initial position I shown in FIG. 1 and as represented by final phase d of curve 22. Such movement is accomplished by drawing rod 2 to the right as shown in FIG. 4.

The invention thus provides an ejection mechanism for the catcher mechanism of a weaving machine which allows for rapid handling of shuttles thus increasing the picking capacity of the machine. Both the method and apparatus of the invention are highly effective and adopted to provide incrased weaving machine speed.

What is claimed is:

1. A catcher mechanism for a gripper shuttle having a pair of jaws for holding a yarn therebetween, said mechanism comprising a housing disposed in a feed path of a series of gripper shuttles to sequentially receive a gripper shuttle therein at a preset location, said housing having an ejection channel on one side of said feed path to receive an ejected shuttle; and an ejection mechanism on an opposite side of said feed path from said ejection channel including an opener pin for opening the jaws of a gripper shuttle at said preset location, an opener lever having said pin mounted thereon and being pivotally movable from a set position towards said preset location to effect opening of the jaws of a gripper shuttle, means including a pivotable drive lever and a link pivotally connected to said drive lever and to said opener lever for pivoting said lever from said set position towards said preset location, second means including a pivotally mounted lever pivotally connected at one end to said opener lever and a reciprocable drive rod connected to said opener lever and to said pivotally mounted lever at an intermediate point for reciprocally moving said lever laterally of said feed path from said preset location to an ejection position and a shaft having said lever of said second means and said drive lever of said first means pivotally mounted thereon, said first means and said second means being disposed to pivot said lever away from said ejection position to permit ejection of a gripper shuttle thereat and to a position with said lever and said pin out of said feed path prior to a return movement of said lever laterally to said set position whereby a following gripper shuttle can be received at said preset location.

2. A method of operating a catcher mechanism of a gripper shuttle weaving machine comprising the steps of feeding a gripper shuttle having a pair of jaws through a feed path to a preset location;

pivoting a lever having an opener pin thereon from one side of said feed path from a set position towards said preset location to move the pin between the jaws;

moving the lever and shuttle laterally of said feed path from said preset location to an ejection position on an opposite side of said feed path from said one side;

thereafter pivoting the lever away from said ejection position to permit ejection of the shuttle thereat and to a raised position with the lever and pin out of said feed path prior to a return movement of the lever laterally to said set position;

then feeding a second gripper shuttle through said feed path into said preset location; and returning the lever laterally from said raised position to said set position.

* * * * *

UNITED STATES PATENT AND TRADEMARK OFFICE

CERTIFICATE OF CORRECTION

PATENT NO. : 4,192,356
DATED : March 11, 1980
INVENTOR(S) : ERWIN PFARRWALLER

It is certified that error appears in the above—identified patent and that said Letters Patent is hereby corrected as shown below:

Column 1, line 63, after "location" insert --to an ejection position--

Column 3, line 48, change "not shown" to --(not shown)--

Signed and Sealed this

*Twenty-second* Day of *July 1980*

[SEAL]

*Attest:*

SIDNEY A. DIAMOND

*Attesting Officer*

*Commissioner of Patents and Trademarks*